US006759615B2

(12) United States Patent
Yamaguchi et al.

(10) Patent No.: US 6,759,615 B2
(45) Date of Patent: Jul. 6, 2004

(54) SWITCH DEVICE

(75) Inventors: Hiroaki Yamaguchi, Aichi (JP); Toshiki Akita, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/385,462

(22) Filed: Mar. 12, 2003

(65) Prior Publication Data

US 2003/0173202 A1 Sep. 18, 2003

(30) Foreign Application Priority Data

Mar. 15, 2002 (JP) ..... P2002-072062

(51) Int. Cl.[7] ..... H01H 13/56
(52) U.S. Cl. ..... 200/523; 200/341
(58) Field of Search ..... 200/314, 341, 200/520–524, 533, 535, 16 R–16 D

(56) References Cited

U.S. PATENT DOCUMENTS 4,238,653 A * 12/1980 Brandt ..... 200/524
4,543,459 A * 9/1985 Hayashida ..... 200/453
4,661,667 A * 4/1987 Sorimachi et al. ..... 200/314
4,916,277 A * 4/1990 Tretter ..... 200/524
4,937,409 A * 6/1990 Hayashi ..... 200/524
5,670,762 A * 9/1997 Futamura ..... 200/16 D
6,326,572 B1 * 12/2001 Yu ..... 200/524
6,392,180 B1 * 5/2002 Yu ..... 200/523
6,420,670 B1 * 7/2002 Yu ..... 200/524
6,433,291 B1 * 8/2002 Mori et al. ..... 200/437
6,504,122 B2 * 1/2003 Yu ..... 200/524

* cited by examiner

*Primary Examiner*—Elvin Enad
*Assistant Examiner*—Lisa Klaus
(74) *Attorney, Agent, or Firm*—Morgan, Lewis & Bockius LLP

(57) ABSTRACT

A lock pin (9) is mounted on an operating member (4), with its proximal end portion (9*a*) fitted therein. A distal end portion (9*b*) of this lock pin can slide in a cam groove so as to releasably hold the operating member in two positions. A holding spring (10) is mounted on the operating member, and urges the lock pin toward a bottom surface of the cam groove. A pin engagement portion (15), which engages the lock pin to prevent the dropping of the lock pin in a condition before the operating member is mounted, is formed on the operating member. An engagement cancellation portion, which disengages the lock pin from the pin engagement portion in a mounted condition of the operating member, is formed on a switch base.

5 Claims, 5 Drawing Sheets

SWITCH DEVICE

BACKGROUND OF THE INVENTION

The invention relates to a switch device which includes a cam groove and a lock pin, and has the function of holding an operating member in two positions.

A so-called push lock-type switch device has the following construction. A cam groove, having, for example, a heart-shape, is formed in one of a device body and an operating member movably mounted on the device body, while a lock pin is provided at the other, and the lock pin slides in the cam groove in accordance with the movement of the operating member so as to hold the operating member in two positions (an original position and a pushed-in position). A holding spring for urging the lock pin toward the cam groove is provided together with this lock pin.

FIG. 6 shows the portion of the operating member of the above conventional construction including the lock pin and the holding spring. The operating member 51 is mounted on the device body (not shown) for reciprocal movement in directions of arrow Q. A proximal end portion 52*a* of the lock pin 52 is fitted in a fitting hole 51*a* formed in the operating member 51. A distal end portion 52*b* of the lock pin 52 is held in sliding contact with the cam groove (not shown). The holding spring 53 has a linear shape, and has opposite end portions fitted respectively in fitting grooves 51*b* and 51*b*. The holding spring 53 serves to urge the lock pin 52 toward the cam groove.

In this construction, when mounting the operating member 51 on the device body (not shown), there is a fear that the lock pin 52 drops, and the assembling operation must be carried out while taking care not to allow the lock pin to drop. And besides, since this switch device itself is small, there has been encountered a disadvantage that the efficiency of the assembling operation is low.

SUMMARY OF THE INVENTION

This invention has been made under the above circumstances, and an object of the invention is to provide a switch device in which a device body and an operating member can be assembled together while preventing the dropping of a lock pin, and besides the lock pin can be moved in a predetermined manner after the assemblage.

In order to solve the aforesaid object, the invention is characterized by having the following arrangement.

(1) A switch device comprising:

a device body;

an operating member, for operating a switch portion by movement thereof, reciprocally movably mounted on the device body;

a cam groove portion formed in one of the device body and the operating member;

a lock pin which includes a proximal end portion mounted on the other of the device body and the operating member, and a distal end portion which can slide in the cam groove portion so as to releasably hold the operating member in two positions;

a holding spring for urging the lock pin toward a bottom surface of the cam groove portion, mounted on the other of the device body and the operating member with its opposite end portions fitted therein;

a pin engagement portion, for engaging the lock pin to prevent the dropping of the lock pin in a condition before the operating member is mounted, formed on the other of the device body and the operating member; and an engagement cancellation portion, for disengaging the lock pin from the pin engagement portion in a mounted condition of the operating member, formed on the one of the device body and the operating member.

(2) The switch device according to (1), wherein a holding spring engagement portion for preventing the dropping of the holding spring in the condition before mounting the operating member is formed on the other of the device body and the operating member.

(3) The switch device according to (1), wherein the lock pin is adapted to rotate about the proximal end portion, the distal end portion of the lock pin is moved within a movement range of the cam groove when the operating member performs the switching operation, and the pin engagement portion is provided outside the movement range.

(4) The switch device according to (1), wherein an engagement cancellation portion for disengaging the lock pin from the pin engagement portion is formed on the one of the device body and the operating member.

(5) The switch device according to (4), wherein when the operating member is assembled to the device body, the engagement cancellation portion disengages the lock pin from the pin engagement portion and move the lock pin to the movement range.

DETAILED DESCRIPTION OF PREFERRED EMBODIMENTS

Figure 1:
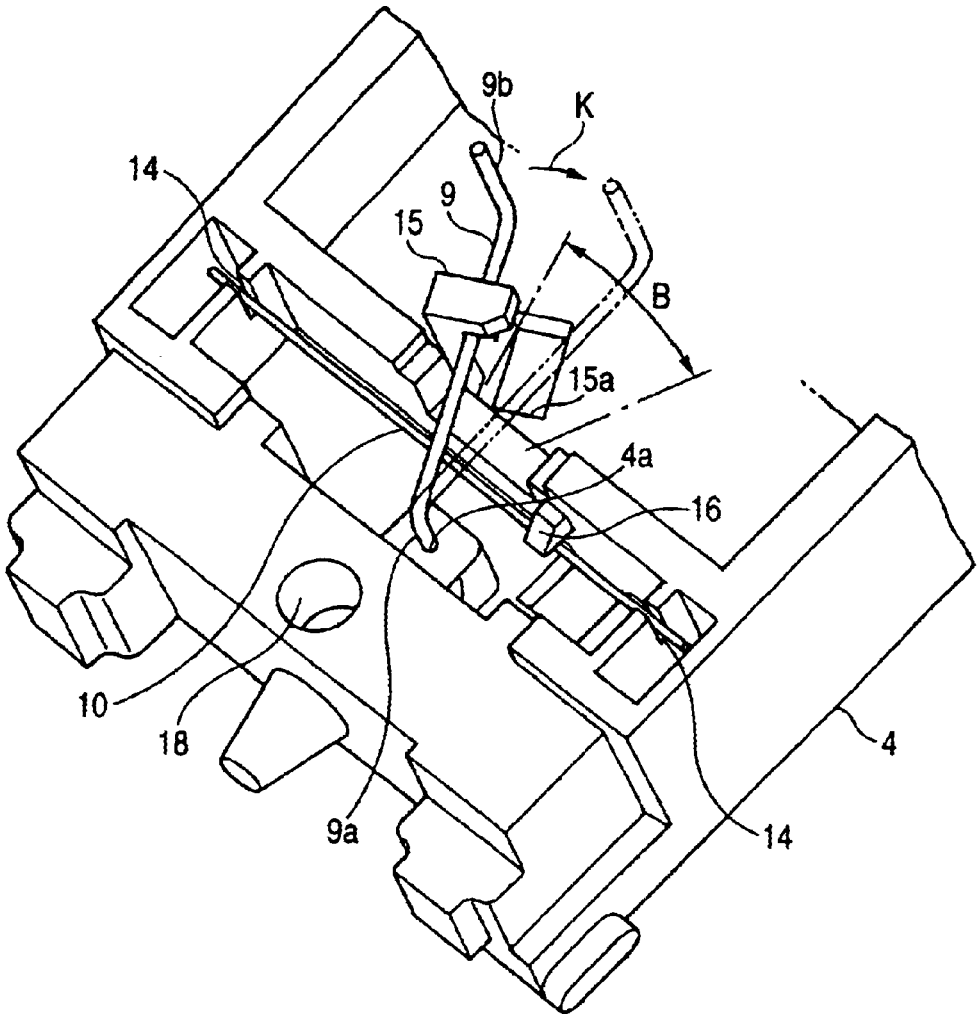
FIG. 1 is a perspective view of a portion of one preferred embodiment of the present invention, showing an operating member in a condition before it is mounted.

One preferred embodiment of the present invention will now be described with reference to FIGS. 1 to 5. FIG. 2 is a cross-sectional view of a push lock-type switch device, and in the FIG. 2, an insulator 2 is fixedly mounted on a tubular switch case 1, and a switch base 3 serving as a device body is formed by the switch case 1 and the insulator 2.

An operating member 4 is mounted within the switch case 1 so as to reciprocally move upward and downward (FIG. 2). A return spring 5 constituted by a compression coil spring is provided between the operating member 4 and the switch case 1, and the operating member 4 is normally urged in a direction of arrow A (FIG. 2), that is, toward an original position, by an urging force of the return spring 5. A knob 6 is mounted on an upper portion (FIG. 2) of the operating member 4.

A lock mechanism 7 is provided between the insulator 2 of the switch base 3 and the operating member 4. This lock mechanism 7 includes a cam groove 8 formed in that surface of the insulator 2 (see FIGS. 4 and 5) facing the operating member 4, a lock pin 9 mounted at its proximal end portion 9*a* (shown also in FIG. 1) on the operating member 4, and a bar-like holding spring 10 mounted on the operating member 4 to urge a distal end portion 9*b* of the lock pin 9 toward a bottom surface of the cam groove 8.

Figure 4:
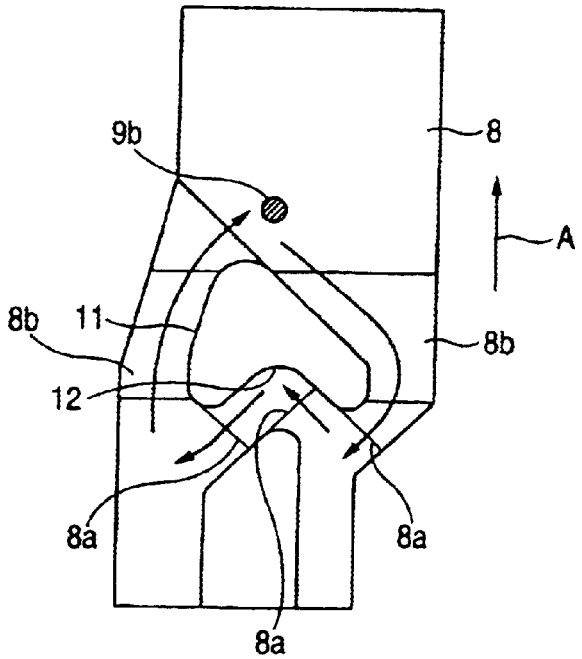
FIG. 4 is a front-elevational view of a cam groove.
Figure 5:
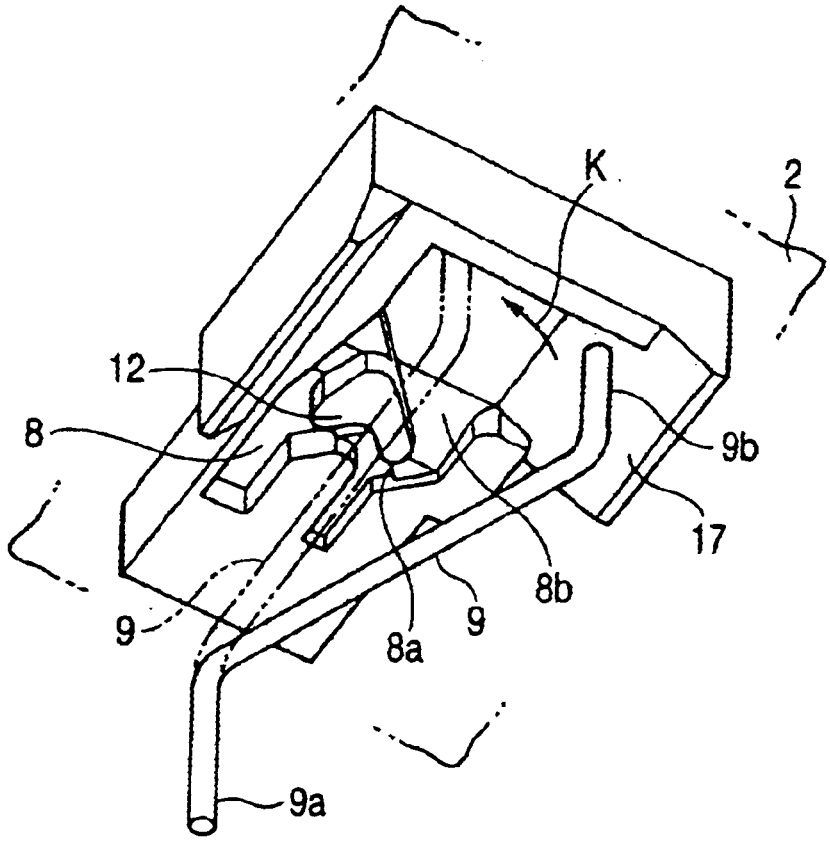
FIG. 5 is a perspective view of a portion of a switch base, showing the cam groove and an engagement cancellation portion.
Figure 6:
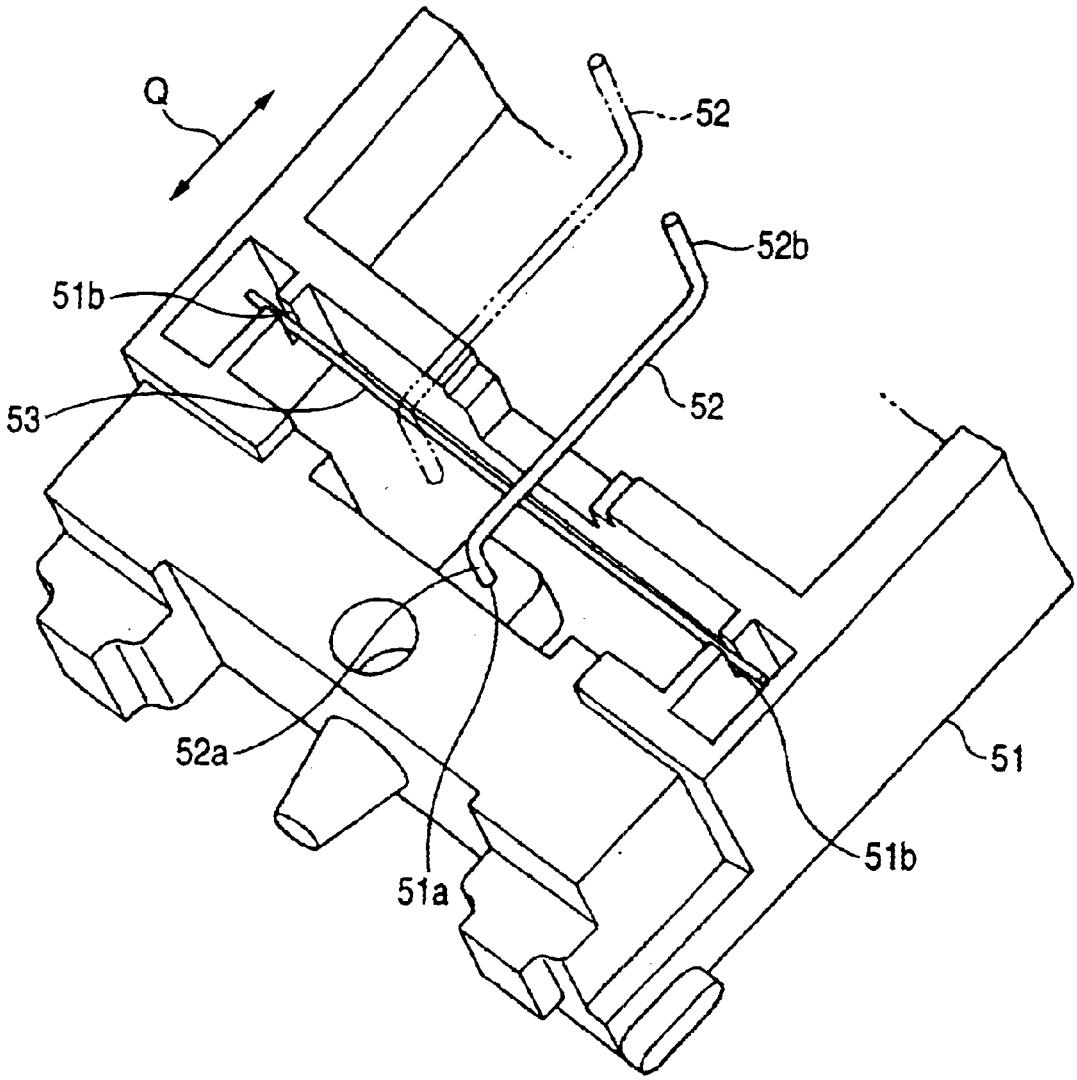
FIG. 6 RELATED ART
FIG. 6 is a view similar to FIG. 1, but showing a conventional example.

As shown in FIGS. 4 and 5, a heart-shape convex portion 11 is formed at a central portion of the cam groove 8, and a generally V-shaped engagement portion 12 is formed at this convex portion 11. A step portion 8*a* and a slanting surface 8*b* are formed on the bottom surface of the cam groove 8. The lock pin 9 has a crank-shape, and is mounted on the operating member 4 by fitting its proximal end portion 9*a* in a fitting hole 4*a* formed in the operating member 4. The distal end portion 9*b* of the lock pin 9 is directed toward the cam groove 8, and can slide along the cam groove 8.

The bar-like holding spring 10 is mounted on the operating member 4 by fitting its opposite ends respectively in fitting grooves 14 formed in the operating member 4.

A pin engagement portion 15 is formed on the operating member 4, and is disposed at a position (indicated in a solid line in FIG. 1) outside the range of normal movement (indicated by reference sign B in FIG. 1) of the lock pin 9. This pin engagement portion 15 has an L-shape open toward the range B of movement of the lock pin 9. A mold removal hole 15*a* is formed in opposed relation to the pin engagement portion 15. This pin engagement portion 15 is engaged with the lock pin 9 to prevent this lock pin 9 from disengagement from the fitting hole 4*a*.

A holding spring engagement portion 16 is formed on the portion of the operating member 4 corresponding to the holding spring 10. This holding spring engagement portion 16 is engaged with the holding spring 10 to prevent the holding spring 10 from disengagement from the fitting grooves 14.

As shown in FIG. 5, an engagement cancellation portion 17 is formed on that portion of the insulator 2 of the switch base 3 corresponding to the distal end portion 9*b* of the lock pin 9 engaged with the pin engagement portion 15. The engagement cancellation portion 17 is formed into a slanting surface.

A spring receiving portion 18 is formed in the portion of the operating member 4 disposed below the check pin 9 (FIG. 2), and a spring member 20 constituted by a compression coil spring is received in this spring receiving portion 18, and a moving contact 19 is urged toward the insulator by this spring member 20. A fixed contact 21 is provided on the surface of the insulator 2 over which the moving contact 19 slides, and the moving contact 19 is brought into and out of contact with this fixed contact 21. The moving contact and the fixed contact 21 jointly form a switch portion 22.

Next, in the above construction, an assembling procedure will be described.

Figure 2:
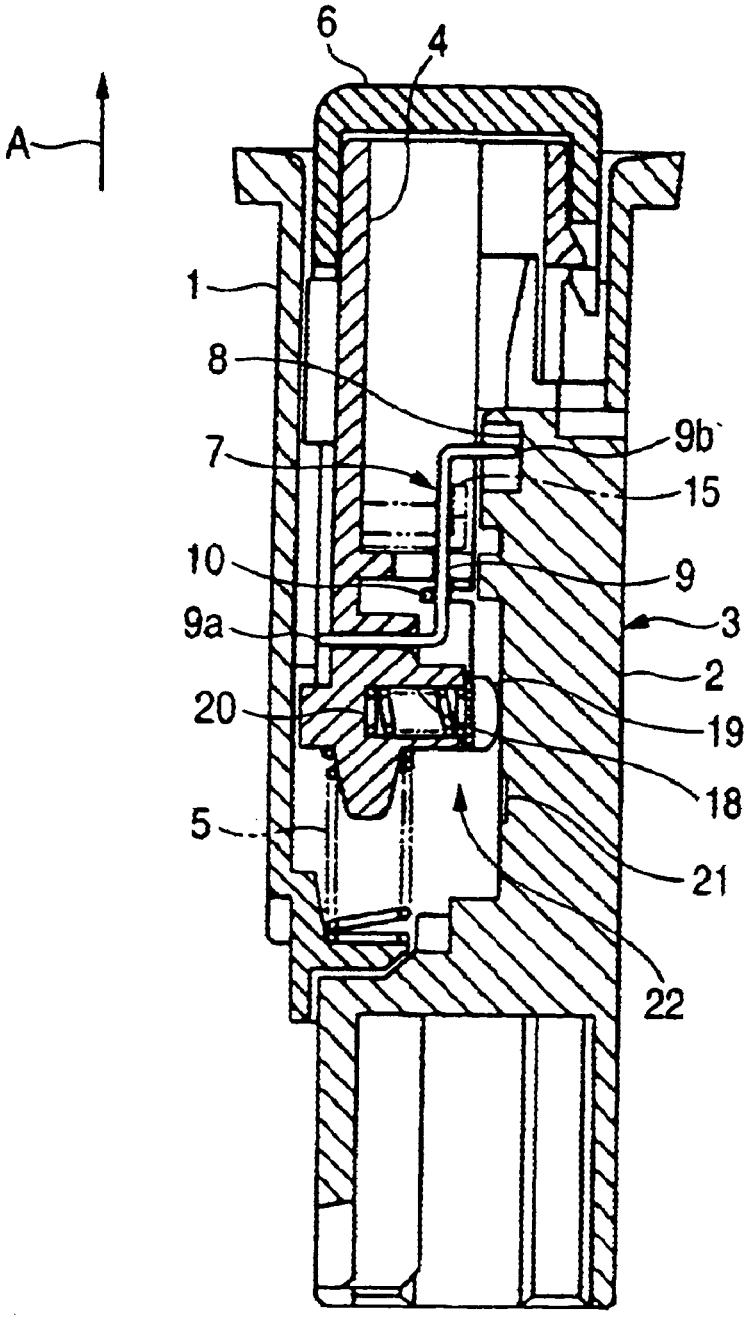
FIG. 2 is a vertical cross-sectional view of the overall construction.
Figure 3:
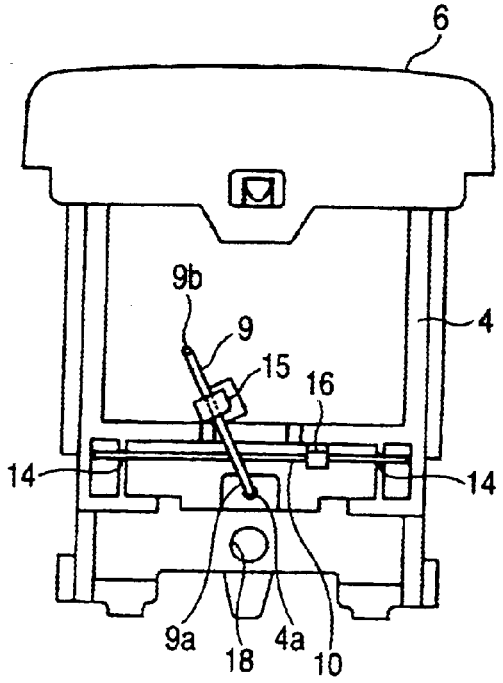
FIG. 3 is a front-elevational view showing the mounting member in the condition before it is mounted.

In FIG. 1, the operating member 4 is in a condition before it is mounted on the switch base 3, and in this condition, first, the holding spring 10 is fitted into the fitting grooves 14 and 14, and this holding spring 10 is slightly flexed inwardly, and then is brought into engagement with the holding spring engagement portion 16 by its returning active. As a result, the holding spring 10 is provisionally held in a dropping-preventing condition.

Then, the proximal end portion 9*a* of the lock pin 9 is inserted and fitted into the fitting hole 4*a*, and this lock pin 9 is slightly flexed inwardly, and then is brought into engagement with the pin engagement portion 15 by its returning action. In this case, the lock pin 9 may flex the holding spring 10 further inwardly. The mounting of the lock pin 9 on the operating member 4 can be easily effected since the holding spring 10 has already been provisionally retained.

Thereafter, the operating member 4 including the lock pin 9 and the holding spring 10 mounted thereon is mounted on the switch base 3. In this case, since the lock pin 9 and the holding spring 10 are mounted on the operating member 4 in a dropping-preventing manner, the assembling ability is enhanced. During the assembling operation, the engagement cancellation portion 17 of the switch base 3 abuts against the distal end portion 9*b* of the lock pin 9, so that the crystal end portion 9*b* is guided in a direction of arrow K (FIGS. 1 and 5) by the slanting surface thereof, and is brought out of engagement with the engagement portion 15, and is moved to the movement range B (the portion of the cam groove 8). In this assembled condition, the holding spring 10 holds the lock pin 9 toward the cam groove 8, and urges the distal end portion 9*b* of the lock pin 9 toward the bottom surface of the cam groove 8.

FIG. 2 shows a condition in which the operating member 4 is located in the original position, and in this condition the moving contact 19 is spaced apart from the fixed contact 21, so that the switch portion 22 is in the OFF state. In the condition of FIG. 2, when the operating member 4 is pushed in a direction opposite to the direction of arrow A against the bias of the return spring 5, the operating member 4 is moved in this direction, and at the same time the distal end portion 9*b* of the lock pin 9 slides along the cam groove 8. Then, when the application of the pushing force to the operating member 4 is canceled, the operating member 4 returns in the direction of arrow A, and at the same time the distal end portion 9*b* of the lock pin 9 is brought into engagement with the engagement portion 12 of the cam groove 8, thereby holding the operating member 4 in the pushed-in position. At this time, the moving contact 19 is brought into contact with the fixed contact 21, so that the switch portion 22 is turned on.

Thereafter, when the operating member 4 is again pushed in the direction opposite to the direction of arrow A, the operating member 4 is moved in this direction, so that the distal end portion 9*b* of the lock pin 9 is brought out of engagement with the engagement portion 12. Then, when the application of the pushing force to the operating member 4 is canceled, the operating member 4 is returned to the original position by the bias of the return spring 5, and at the same time the distal end portion 9*b* of the lock pin 9 slides along the cam groove 8, and returns to the initial position, so that the switch portion 22 is turned off.

In this embodiment, the pin engagement portion 15, which is engaged with the lock pin 9 to prevent the dropping of the lock pin 9 in the condition before the operating member 4 is mounted, is formed on the operating member 4 on which the lock pin 9 is mounted, and therefore when mounting the operating member 4 on the switch base 3, the lock pin 9 will not drop, and the assembling operation can be simplified. And besides, the engagement cancellation portion 17, which disengages the lock pin 9 from the engagement portion in the mounted condition of the operating member 4, is formed on the operating member 4 having the cam groove 8, and therefore after the assemblage, the lock pin 9 is disengaged from the pin engagement portion 15, and can make the predetermined movement.

Furthermore, in this embodiment, the holding spring engagement portion 16, which prevents the dropping of the holding spring 10 in the condition before the operating member 4 is mounted, is formed on the switch base 3 on which the holding spring 10 is mounted, and therefore the dropping of the holding spring 10 during the assembling operation is prevented, and the assembling operation is easier.

In this embodiment, although the cam groove is formed in the switch base, serving as the device body, while the lock pin is mounted on the operating member, these arrangements may be reversed.

As is clear from the foregoing description, in the present invention, there are achieved excellent advantages that the device body and the operating member can be assembled together while preventing the dropping of the lock pin, and that after the assemblage, the lock pin can make the predetermined movement.

What is claimed is:

1. A switch device comprising:

a device body;

an operating member, for operating a switch portion by movement thereof, reciprocally movably mounted on the device body;

a cam groove portion formed in one of the device body and the operating member;

a lock pin which includes a proximal end portion mounted on the other of the device body and the operating member, and a distal end portion which can slide in the cam groove portion so as to releasably hold the operating member in two positions;

a holding spring for urging the lock pin toward a bottom surface of the cam groove portion, mounted on the other of the device body and the operating member with its opposite end portions fitted therein;

a pin engagement portion, for engaging the lock pin to prevent the dropping of the lock pin in a condition before the operating member is mounted, formed on the other of the device body and the operating member; and an engagement cancellation portion, for disengaging the lock pin from the pin engagement portion in a mounted condition of the operating member, formed on the one of the device body and the operating member.

2. The switch device according to claim 1, wherein a holding spring engagement portion for preventing the dropping of the holding spring in the condition before mounting the operating member is formed on the other of the device body and the operating member.

3. The switch device according to claim 1, wherein the lock pin is adapted to rotate about the proximal end portion, the distal end portion of the lock pin is moved within a movement range of the cam groove when the operating member performs the switching operation, and the pin engagement portion is provided outside the movement range.

4. The switch device according to claim 1, wherein the engagement cancellation portion for disengaging the lock pin from the pin engagement portion is formed on the one of the device body and the operating member.

5. The switch device according to claim 4, wherein when the operating member is assembled to the device body, the engagement cancellation portion disengages the lock pin from the pin engagement portion and move the lock pin to the movement range.

* * * * *